US005566861A

United States Patent [19]

Serano

[11] Patent Number: 5,566,861

[45] Date of Patent: Oct. 22, 1996

[54] POURING CONTAINER

[76] Inventor: Andrew Serano, 224 E. Highland Ave., Philadelphia, Pa. 19118

[21] Appl. No.: 371,093

[22] Filed: Jan. 10, 1995

[51] Int. Cl.[6] ..... B67D 1/16; B65D 8/02; B65D 25/40

[52] U.S. Cl. ..... 222/109; 222/465.1; 222/571; 222/572

[58] Field of Search ..... 222/108, 109, 222/465.1, 566, 571, 572, 575; 220/695, 698, 700, 701

[56] References Cited

U.S. PATENT DOCUMENTS

| | | | |
|---|---|---|---|
| D. 246,892 | 1/1978 | East . | |
| D. 260,735 | 9/1981 | Heath . | |
| D. 262,193 | 12/1981 | Fowkes . | |
| D. 269,596 | 7/1983 | Fowkes . | |
| D. 270,620 | 9/1983 | Owens . | |
| D. 271,858 | 12/1983 | Martin et al. . | |
| D. 275,181 | 8/1984 | Jeffries et al. . | |
| D. 276,595 | 12/1984 | Miller . | |
| D. 288,139 | 2/1987 | van Berne et al. . | |
| D. 288,535 | 3/1987 | Bozich . | |
| D. 317,411 | 6/1991 | Holmes . | |
| D. 320,551 | 10/1991 | Wilson . | |
| D. 328,864 | 8/1992 | Grunzweig . | |
| D. 331,015 | 11/1992 | Kerr . | |
| D. 335,082 | 4/1993 | Delorey . | |
| D. 341,318 | 11/1993 | Brown . | |
| 1,421,696 | 7/1922 | Kucera | 222/572 |
| 1,651,485 | 12/1927 | Thesen | 222/572 |
| 1,837,618 | 12/1931 | Gutmann . | |
| 2,312,044 | 2/1943 | Moore . | |
| 2,324,338 | 7/1943 | Tripp . | |
| 2,640,628 | 6/1953 | Klosky | 222/572 X |
| 2,646,193 | 7/1953 | Best . | |
| 2,950,029 | 8/1960 | Winstead . | |
| 3,829,926 | 8/1974 | Salladay | 222/572 X |
| 4,893,734 | 1/1990 | Chlystun . | |
| 4,941,586 | 7/1990 | Tarna | 222/572 |
| 5,160,067 | 11/1992 | Luber . | |
| 5,181,630 | 1/1993 | McNally . | |
| 5,322,183 | 6/1994 | Strachan . | |
| 5,341,969 | 8/1994 | Accardo et al. | 222/572 X |

*Primary Examiner*—Kevin P. Shaver
*Attorney, Agent, or Firm*—Miller & Christenbury

[57] ABSTRACT

This invention provides an article for containing and pouring material. The article includes a container with an open end, a bottom, a wall extending from the bottom to the open end and forming at least one corner, a lip extending from the wall at the open end and toward a central axis of the container, and a pouring spout at the corner. The pouring spout is positioned on an interior surface of the wall and has a contour for directing material to the corner and out of the open end. The contour is formed by increasing the thickness of the wall on both sides of the corner. A handle is attached to the container near the open end of the container. A lid is provided having a shape adapted to cover the open end of the container and create a seal with the lip of the container.

15 Claims, 5 Drawing Sheets

POURING CONTAINER

BACKGROUND OF THE INVENTION

This invention relates to an article for containing and pouring pourable materials. In particular, this invention relates to a container having a pouring spout shaped and positioned to reduce material spillage and waste.

FIELD OF THE INVENTION

There is a constant demand for improved containers from which materials can be efficiently poured. It is desired to reduce or eliminate the expense and frustration associated with spilled materials.

For the purpose of illustration, paint is commonly sold in cans having a cylindrical wall terminating in a lip to create a circular opening. Painters frequently pour paint from the can during paint application or paint mixing.

There are several disadvantages associated with such paint cans. The circular opening of the cans causes spillage when paint is poured. The paint flows over a large circumferential portion of the rim, thereby forming a wide stream that is difficult to direct. Also, paint tends to spill over the outer surface of the cylindrical wall and is wasted each time paint is poured from the container. Paint also accumulates in the circumferential portion of the paint can rim, wasting additional paint and making it difficult to reseal the paint can lid.

The paint industry is just one example of the waste associated with many conventional containers used for pourable materials.

OBJECTS OF THE INVENTION

It is an object of this invention to provide an article for containing and pouring pourable materials that overcomes the problems associated with prior art containers.

It is another object of this invention to provide a container from which material can be poured with minimal material spillage and waste.

Another object of this invention is to provide a container that is inexpensive to manufacture and ship as well as efficient to store and display.

Other important objects will become apparent to one of ordinary skill in the art in view of the descriptions that follow.

SUMMARY OF THE INVENTION

This invention provides a container for pourable materials having a bottom, a wall forming at least one corner, a lip extending from the wall and defining a container opening, and a pouring spout located at and near the corner. The pouring spout is contoured to direct material from within the container into the corner and out of the container when material is being poured. The contour forming the pouring spout is preferably integrally formed on the container wall.

DETAILED DESCRIPTION OF THE INVENTION

Figure 1:
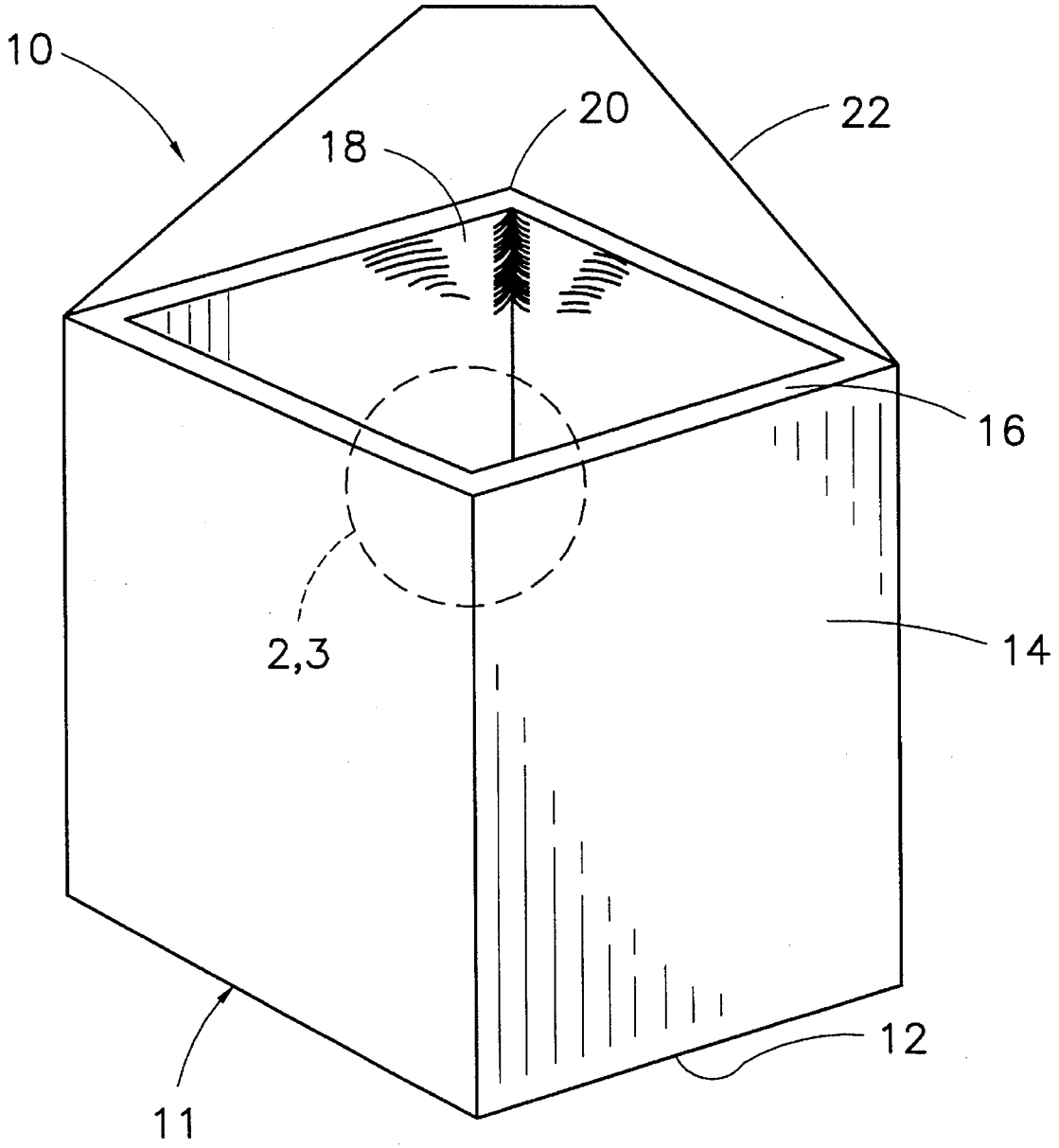
FIG. 1 is a perspectives view of one embodiment of a container article according to this invention.

The following description is intended to refer to the specific embodiments of the invention illustrated in the drawings. This description is not intended to define or limit the scope of the invention, which is defined separately in the claims that follow.

Referring to FIG. 1, the numeral "10" designates generally an article for containing and pouring materials according to this invention. Article 10 includes a container 11 and a lid (not shown) which is described with reference to FIG. 6.

Container 11 has a bottom 12 and a wall 14 extending from bottom 12 to an open end of container 11. Container 11 also includes a lip 16 extending inward toward a central axis of container 11 from wall 14 and defining an opening.

Container 11 also has a pouring spout 18 preferably formed in container wall 14 at a corner 20 defined by wall 14. Details of pouring spout 18 are described hereinafter with reference to FIGS. 4*a*–4*c* and FIGS. 5*b*–5*d*.

Container 11 also includes a handle 22 connected to wall 14 for transport of container 11. Handle 22 is preferably attached at corners of container 11. Handle 22 is most preferably attached at corners located about 90° from pouring spout 18.

Although only one pouring spout 18 is shown in the container embodiment of FIG. 1, it is contemplated that container 11 optionally includes any number of pouring spouts in any number of corners 20.

Container 11 is preferably formed from any plastic material compatible with the material to be contained. Container 11 is preferably molded using any injection- or blow-molding process well known in the art.

The portion of container 11 indicated in the detail designated "2,3" in FIG. 1 will now be described with reference to FIGS. 2 and 3.

Figure 2:
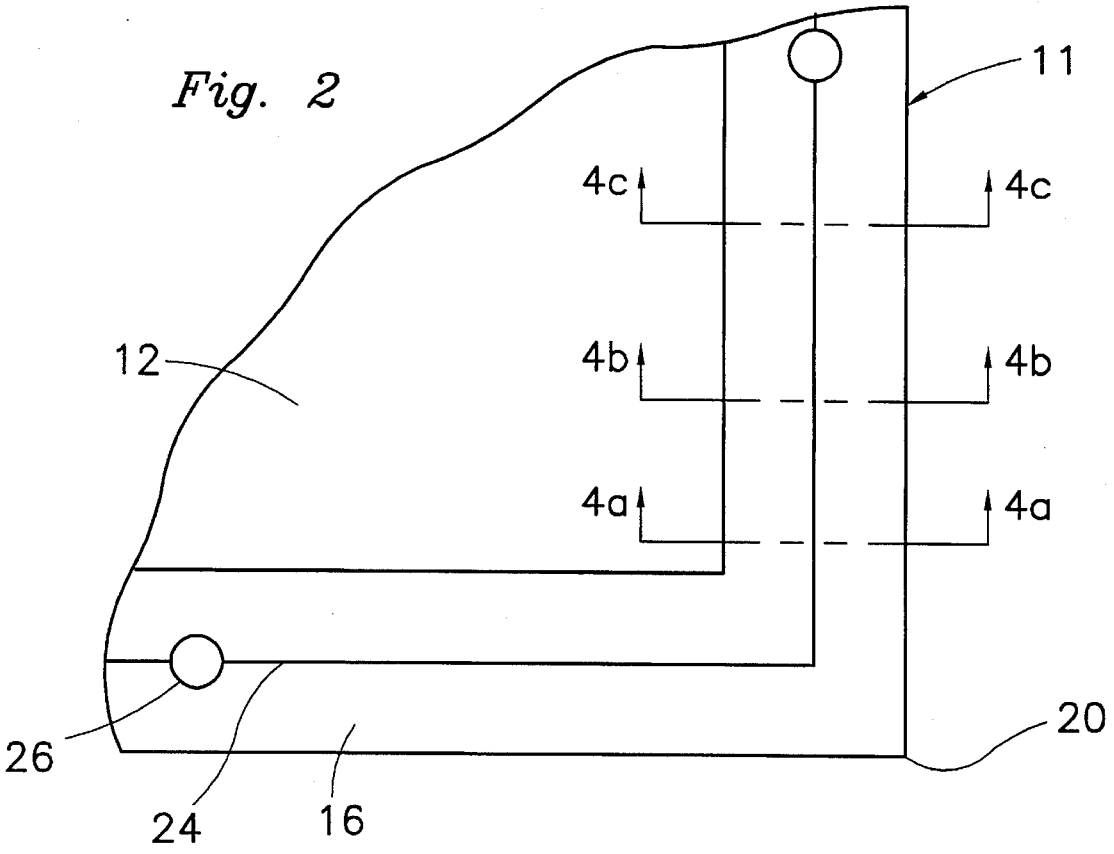
FIG. 2 is a top view of a detail of the container embodiment shown in FIG. 1.

Referring to FIG. 2, which illustrates a top view of a portion of container 11 near corner 20, a trough 24 is positioned in a central portion of lip 16. Trough 24 is shaped to mate and form a seal with the article lid (illustrated in, and described with reference to, FIG. 6). Lip 16 is also provided with optional drainage holes 26 located along trough 24. Drainage holes 26 communicate with the interior of container 11 to permit drainage of material trapped in trough 24 into the container interior.

Figure 3:
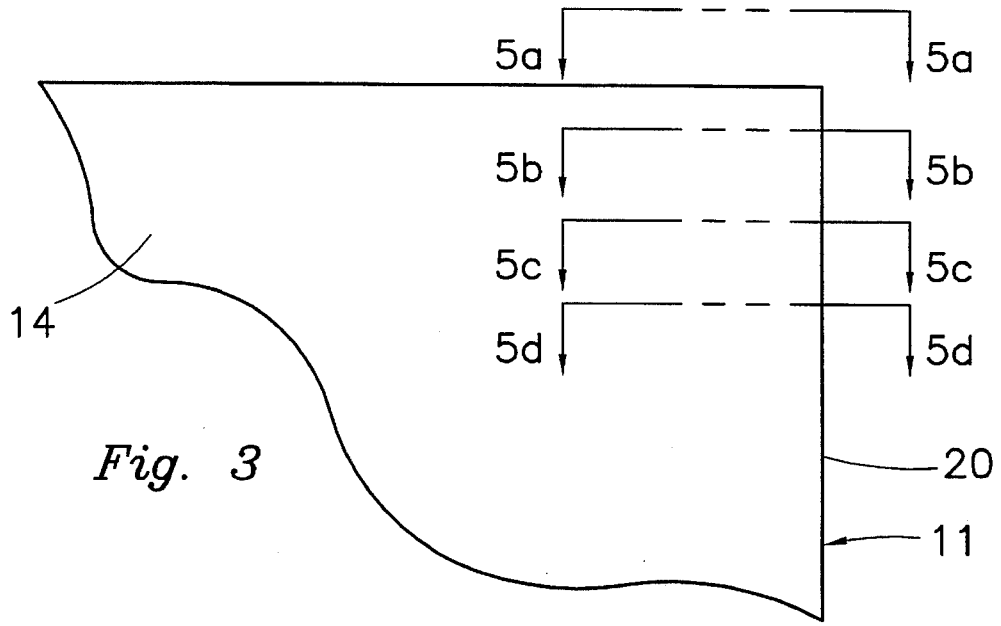
FIG. 3 is a side view of a detail of the container embodiment shown in FIG. 1.

FIG. 3 shows a side view of a portion of container 11 adjacent corner 20.

Figure 4C:
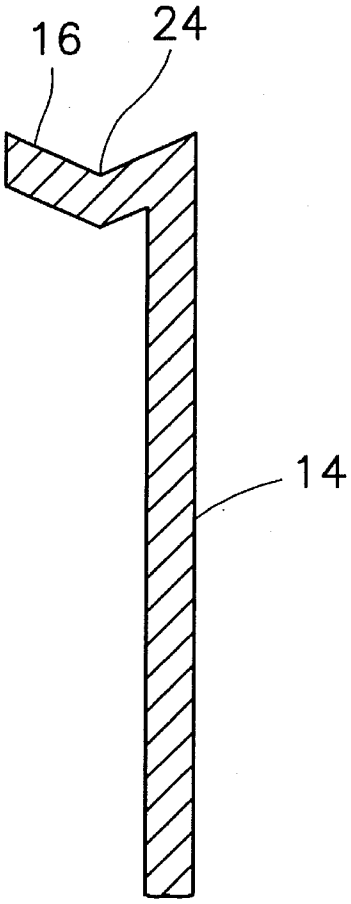
FIGS. 4*a*–4*c* are cross-sectional views defined in FIG. 2, revealing details of the container embodiment shown in FIG. 1.
Figure 4B:
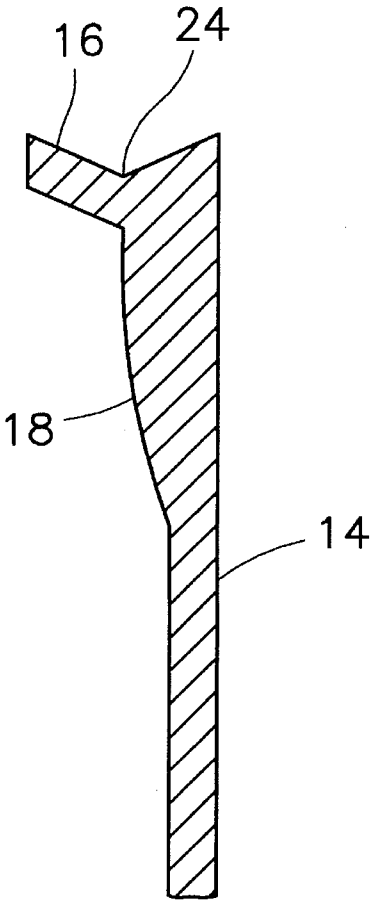
Figure 4A:
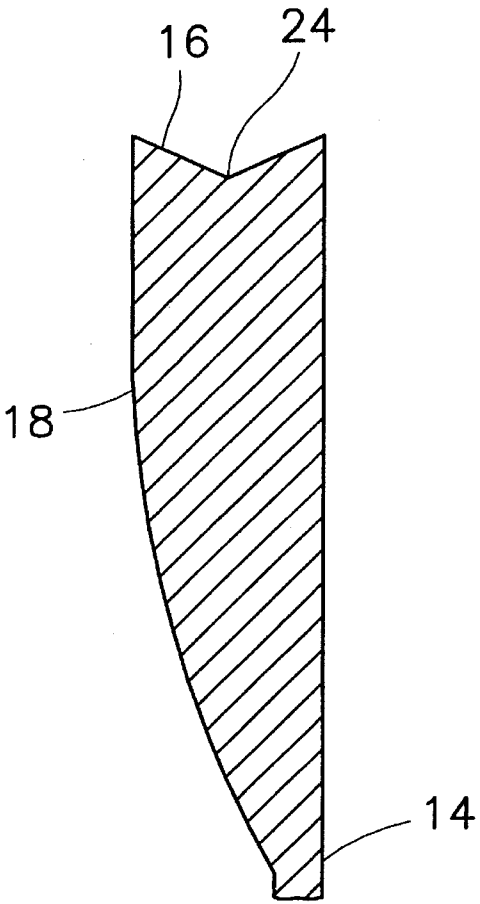

FIGS. 4*a*–4*c* illustrate details of pouring spout 18 on wall 14 in locations progressively farther from corner 20 to reveal the contour of pouring spout 18. FIGS. 4*a*–4*c* also illustrate details of lip 16 and trough 24 as they relate to container wall 14 and pouring spout 18.

Referring to FIG. 4*a*, which is the cross-sectional view closest to corner 20, pouring spout 18 is preferably formed as an integral part of wall 14. In this cross-sectional view, pouring spout 18 has a contour extending out from wall 14 toward the central axis of container 11 for a distance corresponding to the width of lip 16. FIG. 4*a* also reveals the tapered vertical contour of pouring spout 18, wherein spout 18 gradually reduces in thickness from a maximum thickness corresponding to the width of lip 16 and a minimum thickness corresponding to the thickness of wall 14.

Referring to FIG. 4*b*, which is a cross-section of container 11 located farther from corner 20 than that shown in FIG. 4*a*, pouring spout 18 has a contour which tapers as it extends horizontally from corner 20. In FIG. 4*b*, the thickest portion of spout 18 roughly corresponds to the distance between trough 24 and the outer surface of wall 14. Pouring spout 18 blends into wall 14 at a vertical location closer to the top of container 11.

FIG. 4*c* is a cross-sectional view taken farther from corner 20 than FIGS. 4*a* and 4*b* and at a longitudinal location at which pouring spout 18 has blended into wall 14. Accordingly, pouring spout 18 is not present in the cross-section illustrated in FIG. 4*c*.

Figure 5B:
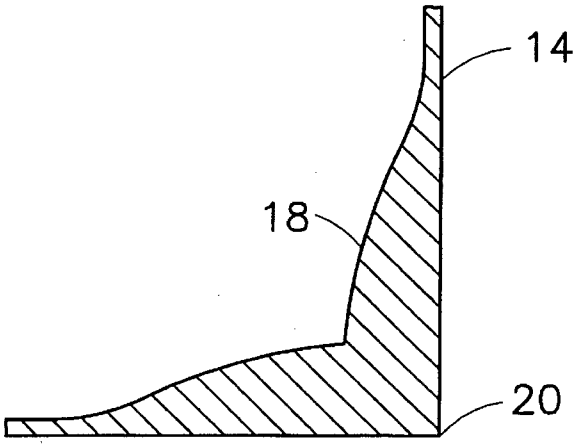
FIGS. 5*a*–5*d* are cross-sectional views defined in FIG. 3, revealing details of the container embodiment shown in FIG. 1.
Figure 5D:
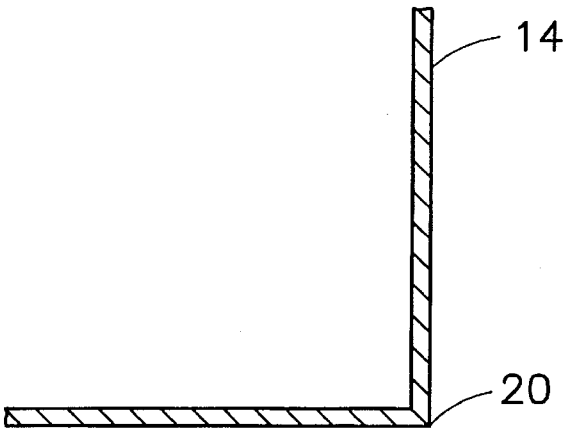
Figure 5A:
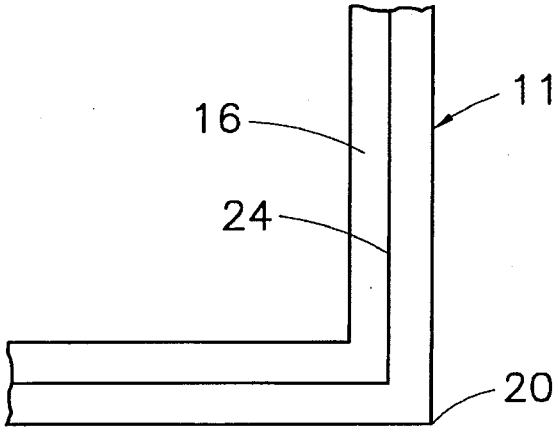

FIG. 5*a* is a top view of a portion of container 11 adjacent corner 20. FIG. 5*a* illustrates the positions of lip 16 and trough 24.

Figure 5C:
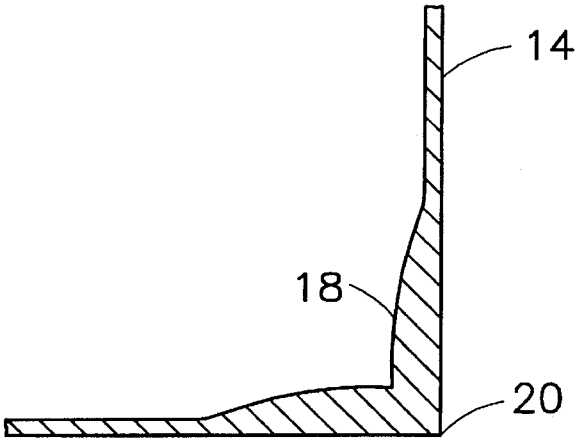

FIGS. 5*b*–5*d* illustrate the contour of pouring spout 18 at vertical positions progressively farther from the top of container 11. FIG. 5*b* shows a cross-section of pouring spout 18 at a position just below lip 16. Pouring spout 18 has a thickness much greater than wall 14 and tapers into the thickness of wall 14 as the spout extends farther from corner 20 (as described above with reference to FIGS. 4*a*–4*c*).

FIG. 5*c* illustrates the contour of pouring spout 18 at a position farther from the top of container 11 than the cross-section shown in FIG. 5*b*. Pouring spout 18 has a smaller thickness, approaching that of wall 14, and blends into wall 14 at a position closer to corner 20.

FIG. 5*d* shows a cross-section located below pouring spout 18 and illustrates a constant-thickness wall 14 throughout the area of corner 20.

As shown in FIGS. 4*a*–4*c* and 5*b*–5*d*, pouring spout 18 preferably has surfaces inclined in a direction toward the central axis of container 11 as the surfaces approach the container opening. Also, pouring spout 18 preferably has surfaces inclined in a direction toward the central axis of container 11 as the surfaces approach the "valley" defined by the spout. The inclined surfaces are most preferably convex in a direction facing the central axis of container 11.

Figure 6:
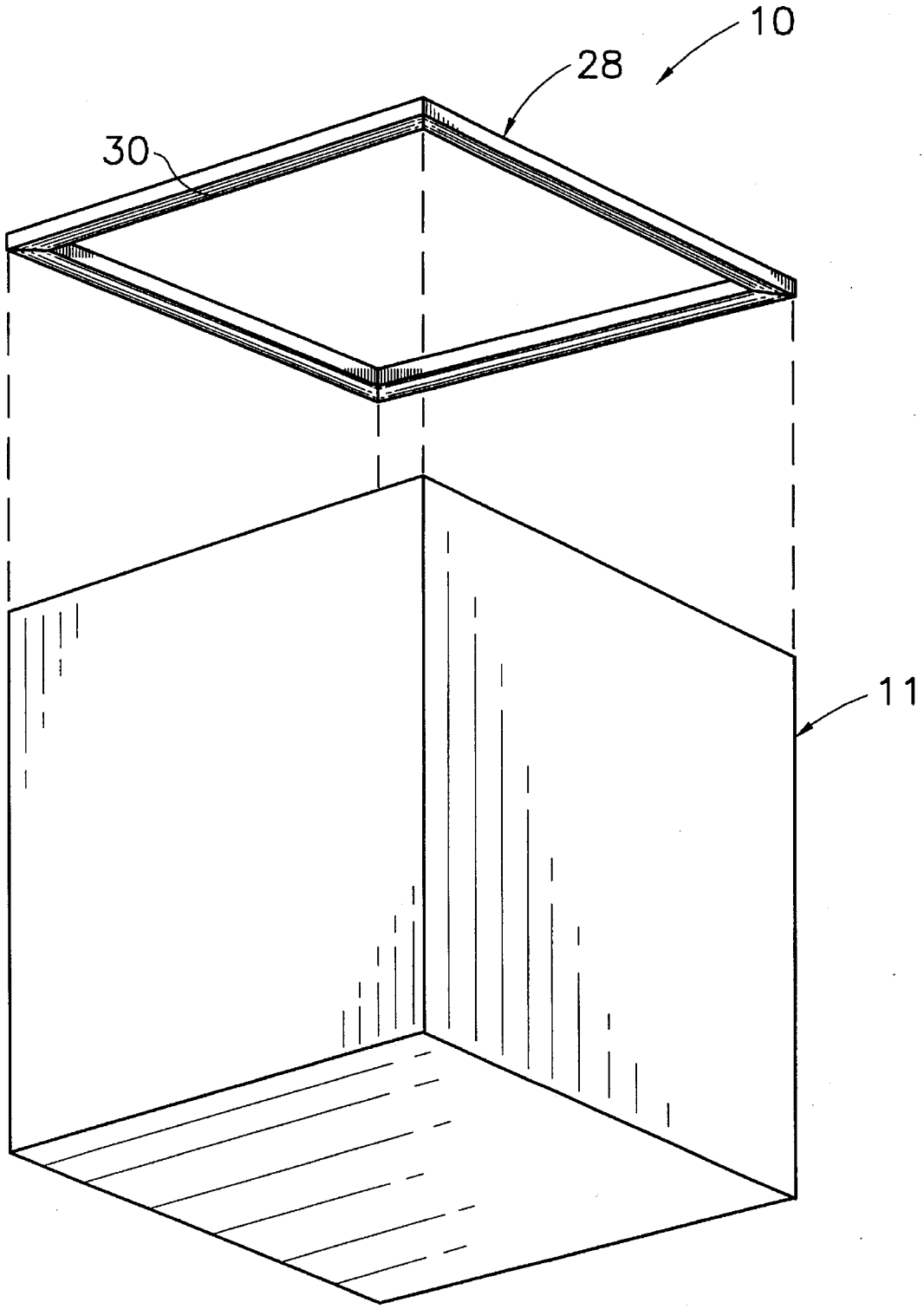
FIG. 6 is a perspective view of an embodiment of the article according to this invention illustrating a lid embodiment together with a container embodiment.

FIG. 6 shows a perspective view of article 10 from the bottom. Illustrated in FIG. 6 is a container lid 28 shaped to close the opening in container 11. Lid 28 has a protrusion 30 around the periphery of lid 28 which meets with trough 24 in lip 16 of container 11. Protrusion 30 mates with trough 24 to create a seal which preferably prevents material from escaping from container 11 and also preferably prevents air from entering container 11. Protrusion 30 preferably contacts the outermost portion of lip 16 between trough 24 and the outside surface of wall 14 to maintain a seal when optional drainage holes 26 are provided in lip 16 at the center of trough 24.

Many modifications can be made to the article described herein without escaping the scope of this invention.

For example, the container and lid are optionally provided with any shape having one or more corners. The container and lid, when viewed from above, optionally have a square, rectangular, or any other geometric or irregular shape with any number of corners. In fact, the container and lid are optionally round when viewed from the top, having a cylindrical wall. It is also contemplated that the shape of the container optionally varies from top to bottom. For example, container 11 is optionally square (with corners) at the top and round (without corners) at the bottom.

The container is preferably formed from a plastic that is compatible with the material to be held within the container. The container is most preferably formed from polyvinyl chloride, polyethylene, polypropylene, or any other suitable polymer. The container is preferably molded using known injection- or blow-molding processes. A molded container is preferably provided with a one-piece construction wherein the pouring spout is defined by variations in the container wall thickness.

The pouring spout is optionally a separate attachment shaped for connection to the container at or near the container opening. Such a spout is optionally shaped for attachment to the lip and/or wall of a container having any shape or size. The spout is optionally provided with any contour, including curved, convex, concave, inclined and/or other surfaces, so long as the spout forms a "valley" on the inner surface of the container to direct material flow from the container.

The container is optionally formed from a metallic material such as the metallic sheet used to form conventional paint containers. If the container is metallic, the pouring spout is optionally formed using known stamping and forming processes or is a separate attachment.

The pouring spout optionally has a variety of configurations so long as it directs material from within the container in a concentrated stream as compared to containers having a circular opening. If the spout is formed integrally with the container wall, the spout is preferably defined by varying the thickness of the container wall. However, the pouring spout is optionally defined by a curvature and/or incline in a container wall of constant thickness.

Although the pouring spout contour shown in FIG. 4*a* has a thickness corresponding to the width of the container lip, the pouring spout optionally extends beyond the lip toward the central axis of the container. It is also contemplated that the lip extends toward the container center at a distance less than the width of the lip.

The optional drainage holes shown in FIG. 2 are preferably positioned periodically around the trough of the lip. Drainage holes are optionally spaced evenly around the lip or, alternatively, are positioned only adjacent one or more corners in the container.

The handle connected to the container for transporting the container is optionally of conventional design, consisting of a thick wire shaped to conform to the outer surface of the container when the handle is pivoted against the container wall. The handle is also optionally formed from plastic and/or configured to fit within a recess formed in the container. For example, a U-shaped metal or plastic handle with vertical "legs" and a horizontal bar is optionally mounted with its legs within vertical holes provided at container corners so that the vertical legs of the handle slide into the container holes. When not in use, the handle slides into the vertical holes in the container and the bar rests within an optional recess formed in the container lid.

The lid is optionally provided with any shape. Also, the lid preferably forms a seal with the container lip, the container wall or a combination of container surfaces.

In any embodiment, the container according to this invention provides significant benefits. The container of this invention facilitates pouring of materials, including liquids, slurries, powders and granulars, with reduced material waste. Also, a significant space-saving benefit is achieved when the container in produced in the optional rectangular or square configuration, as shown in FIG. 1. The diameter of a cylindrical container is significantly larger than the width of a square container having the same height and volumetric capacity. Accordingly, the square container requires less storage, shipment and display-shelf space. This benefit is even more dramatic when considering large numbers of containers. Such space savings represents a significant reduction of storage and display space as well as a significant reduction in shipping expense.

What is claimed is:

1. An article for containing and pouring a material, said article comprising in combination:

a container having an opening, a bottom, a wall extending from said bottom to said opening, a lip extending from said wall at said opening and toward a central axis of said container, and a pouring spout positioned on an interior surface of said wall adjacent said lip, said pouring spout having two or more inclined surfaces facing said central axis of said container and a valley defined by said inclined surfaces for directing material out of said opening; and a lid having a shape adapted to cover said opening of said container and to create a seal with said container.

2. The article described in claim 1, further comprising a handle attached to said container proximal to said opening.

3. The article described in claim 1, wherein said inclined surfaces are inclined in a direction toward said central axis of said container as said inclined surfaces approach said opening of said container.

4. The article described in claim 1, wherein said inclined surfaces are inclined in a direction toward said central axis of said container as said inclined surfaces approach said valley.

5. The article described in claim 1, wherein said inclined surfaces are convex.

6. The article described in claim 1, wherein said container has a one-piece construction.

7. The article described in claim 6, wherein said inclined surfaces are variations in the thickness of said wall of said container.

8. The article described in claim 6, wherein said container is formed from a polymer selected from the group consisting of polyvinyl chloride, polyethylene and polypropylene.

9. The article described in claim 1, further comprising a trough in said lip of said container for sealing engagement with said lid.

10. The article described in claim 9, wherein at least one passage is provided in said lip proximal to said trough to permit drainage of material from said trough to an interior of said container.

11. The article described in claim 1, wherein said wall of said container defines a corner and said pouring spout is positioned adjacent to said corner and on said interior surface of said wall.

12. The article described in claim 11, wherein said container has a square shape when viewed from said opening.

13. The article described in claim 1, wherein said inclined surfaces of said pouring spout extend from said wall and beyond said lip in a direction toward said central axis of said container.

14. The article described in claim 1, wherein said inclined surfaces of said pouring spout extend from said wall but do not extend beyond said lip in a direction toward said central axis of said container.

15. An article for containing and pouring a material, said article comprising:

a container having an opening, a bottom, a wall extending from said bottom to said opening and forming at least one corner, and a lip extending from a portion of said wall proximal to said opening and toward a central axis of said container;

pouring means integrally formed in said wall and defined by an interior surface of said wall below said lip and proximal to said corner, said pouring means having two or more convex surfaces defining a valley shaped to direct material toward said corner and out of said opening when material is being poured from an interior of said container; and a lid sized and shaped for sealing engagement with said container.

* * * * *